US005126013A

United States Patent [19]

Wiker et al.

[11] Patent Number: 5,126,013

[45] Date of Patent: Jun. 30, 1992

[54] MICA AND VERMICULITE PAPER AND ITS PREPARATION

[75] Inventors: Anthony L. Wiker; James L. Work, both of Lancaster, Pa.

[73] Assignee: Armstrong World Industries, Inc., Lancaster, Pa.

[21] Appl. No.: 671,087

[22] Filed: Mar. 18, 1991

[51] Int. Cl.[5] ..... D21H 13/00

[52] U.S. Cl. ..... 162/156; 162/145; 162/146; 162/157.2; 162/168.2; 162/168.3; 162/181.6; 162/183

[58] Field of Search ..... 162/181.6, 152, 156, 162/145, 157.2, 146, 183, 164.6, 168.2, 168.3

[56] References Cited

U.S. PATENT DOCUMENTS 3,916,057 10/1975 Hatch et al. ..... 162/181.6
4,549,931 10/1985 Adamowicz et al. ..... 162/181.4
4,775,586 10/1988 Bohrn et al. ..... 162/181.6

*Primary Examiner*—Peter Chin

[57] ABSTRACT

Mineral paper is provided which comprises a wet-laid sheet of 1) fibers, 2) a floc of a silicate selected from the group consisting of mica and vermiculite, the said floc having a cationic polymeric flocculant having a molecular weight in the range of from about 10,000 to about 1,000,000, and 3) a non-ionic polymeric flocculant having a molecular weight of from about 2,000,000 to about 10,000,000. A process is described herein for the preparation of the paper using the two flocculants by first flocculating with the cationic polymeric flocculant and then flocculating in another step with the non-ionic polymeric flocculant to obtain an easily drained flocculated mixture which is dewatered to obtain the mineral paper.

12 Claims, No Drawings

MICA AND VERMICULITE PAPER AND ITS PREPARATION

BACKGROUND OF THE INVENTION

1. Field of the Invention

It is known that fire resistant papers can be produced from water-swellable inorganic minerals, in particular from dispersions of 2:1 layered silicates.

The 2:1 layered silicate minerals mica and vermiculite are made into flocs by the ion exchange of aqueous dispersions of the mineral lamellae. Flocculating exchange cations, such as those of U.S. Pat. Nos. 4,707,298, 4,877,484, and 4,239,519 (guanidinium, diamine and metal cations) are used to prepare the flocs. Fibrous materials and even fillers can be used and combined with the mineral.

After flocculation, dewatering and conventional paper-making technology allow the formation of paper with these mineral materials. The mineral ingredients give this paper extremely desirable flammability characteristics. Unfortunately, the papers have poor flexibility and poor internal adhesion between the flocculated ingredients.

In addition to this, the flocculating exchange cations that are used to form the silicate floc fail to form a readily drainable flocculated mixture. Thus, in preparing paper from 2:1 layered silicate minerals, processing difficulties are encountered. Although flocculation occurs, the silicate floc is very fine. The fine particles of floc make dewatering and sheet formation slow and difficult. It is also difficult to achieve a good distribution of the fibers throughout the floc.

Advantageously, the present invention provides paper which has good flexibility and has good adhesion between the wet-laid ingredients. In comparison to paper prepared with the cationic flocculants of the prior art, the paper prepared with the present method shows better flexibility and Z-direction strength. The papers of the instant invention also have an excellent fiber distribution.

The method described herein uses a dual, sequential flocculation system that advantageously provides rapid dewatering and sheet formation. This process, moreover, results in paper with excellent physical properties.

SUMMARY OF THE INVENTION

The mineral paper provided comprises a wet-laid sheet of 1) fibers, 2) a floc of a silicate selected from the group consisting of mica and vermiculite having a cationic polymeric flocculant which has from about 3 to about 8 milliequivalents of the cationic moiety per gram of the polymeric flocculant, and further having a molecular weight in the range of from about 10,000 to about 1,000,000, and 3) a non-ionic polyacrylamide flocculant having a molecular weight of from about 2,000,000 to about 10,000,000.

Using the silicate mineral for the paper makes the use of two different flocculants particularly advantageous. With the cationic polymeric flocculant, there is interaction as an exchanging cation (exchanging with the mineral) and there is interaction because these 2:1 layered silicate minerals have a negative charge density. This forms the silicate floc. After the silicate floc forms from the first flocculation, the non-ionic polymeric flocculant can be used to further flocculate the solids into a drainable, flocculated mixture which can easily be dewatered and formed into a sheet using papermaking technology such as the Fourdrinier wire.

A process for the preparation of mineral paper comprises the steps of 1) preparing an aqueous suspension containing fiber and a chemically delaminated 2:1 layered silicate selected from the group consisting of mica and vermiculite, 2) adding a cationic polymeric flocculant which has a molecular weight in the range of from about 10,000 to about 1,000,000 to the aqueous suspension to obtain a flocculation, 3) flocculating again with a non-ionic polyacrylamide flocculant which has a molecular weight of from about 2,000,000 to about 10,000,000, and 4) dewatering the flocculated material to form the mineral paper. It is also possible to include other steps such as the addition of a filler, pigment, more fibers, and/or other additives before adding the non-ionic polyacrylamide flocculant in step 3).

With the instant invention, the flocculants are used in this specific sequence. The cationic polymeric flocculant first forms a silicate floc and, thereafter, the non-ionic polymeric flocculant is used to further flocculate the ingredients, forming the flocculated mass that is dewatered into the paper sheet. The floc of silicate and cationic polymer is a floc which is pre-formed before making the final floc for dewatering. The instant papers are thus a flocculated wet-laid sheet which contains a silicate floc.

Although other processes can be used to prepare the instant papers, for example by combining all of the fibers in a different step, the process described above is preferred. The above process successfully achieves a flocculated aqueous mixture that is very easily drained and provides a homogeneous distribution of the silicate and fiber.

DETAILED DESCRIPTION

The instant invention offers superior silicate paper and a double, sequential flocculation method for silicate paper. Double, sequential flocculation means that there are two flocculation steps wherein flocculation with the cationic flocculant is first. Although it is permissible to perform other steps after the first flocculation and before the second one, the order in which the flocculants are used will not change.

This double, sequential flocculation system is needed with the silicate minerals that are used to make the papers. The mineral is used in the form of a swelled layer aqueous dispersion. Dispersions such as these and methods for making them can be found described in such references as U.S. Pat. No. 4,800,041. It is theorized that the swelled layer mica and vermiculite dispersions form a floc at least partially because of an ion exchange reaction with the flocculating cations and cations in the mineral layers. Although all of the solids (fibers, fillers etc.) are flocculated by the same cationic flocculant which forms flocs from mica and vermiculite dispersions, the flocculation itself is soft (there are small pieces of silicate floc and the ingredients do not form large pieces or clumps). Thus, there are smaller individual pieces of the mineral floc.

With prior art methods, the bond between the flocculated silicate and the fiber is very poor, and even worse, the fiber frequently clumps together instead of being homogeneously dispersed throughout the silicate. This clumping has been noted especially when using ionic flocculants that have molecular weights of about 1,500,000 or more. Dewatering with clumped fiber results in the formation of a non-homogeneous mat.

The present method and highly cationic flocculant avoids these difficulties. The mica and vermiculite minerals have charge densities of −1 for the mica and from about −5 to about −9 for the vermiculite. The first flocculant is a highly cationic polymer which forms the silicate floc without fiber clumping. A uniform distribution of the fibers throughout the silicate floc is noted.

The method of the instant invention and the papers of the present teaching are made with a highly cationic polymer flocculant having a molecular weight in the range of from about 10,000 to about 1,000,000. This flocculant is called "highly cationic" because it should have an ionicity of from about 3 to about 8 milliequivalents (meq.) of the cationic moiety per gram (/g.), preferably there will be from about 4.5 to about 6.5 meq. of cations/g. Most preferably, the cationic moiety is an amine.

In the first flocculation step, the cationic polymer flocculant acceptably is used in an amount of from about 0.04 to about 0.06 grams of the polymer per gram of total solids. ("Total solids" refers to all of the non-flocculant ingredients that are flocculated and drained to form the paper.) At these levels, the final papers can contain up to about 6% by wt. of the cationic polymeric flocculant (generally in the range of from about 3.5 to about 6% by wt. cationic flocculant).

The second flocculation is done with a non-ionic flocculant. This flocculation brings the flocculated solids material closer together. Bigger, heavier pieces of floc are formed, and the fiber is held strongly within the flocced silicate mineral. The water is also more clear than it is after the first flocculation. This floc, containing the two distinct types of flocculants is then drained. Due to the floc's characteristics (large, heavy chunks), the dewatering step proceeds easily and quickly.

The second flocculant is a non-ionic polyacrylamide. It can be referred to as a "high molecular weight" polymeric flocculant, with a molecular weight of from about 2,000,000 to about 10,000,000. The non-ionic flocculant acceptably is used in an amount of from about 0.06 to about 0.08 grams of the polymer per gram of total solids. With the recovery of the solids which can be achieved in paper-making (frequently about 97% or even greater), the final papers can be up to about 8% by wt. of the non-ionic polymeric flocculant (about 5.5 to about 8% by wt.).

The mica and vermiculite papers made by this process have a stronger bonding between the fiber and the silicate floc and have a stronger bond between the silicate lamella. The paper has a homogeneous distribution of fiber.

Acceptably, the silicate and fibers are used in such proportions as to make the final paper from about 5 to about 85% by wt. fiber and from about 20 to about 95% by wt. flocculated silicate. In preferred embodiments, the silicate is present in an amount of from about 90 to about 50% by wt. (weight) and the fiber is present at an amount in the range of from about 7 to about 50% by wt. If a filler is used, the paper can suitably contain from about 0.5 to about 40% by wt.

Using the mineral silicate for the paper gives it desirable flammability and flame resistance properties. This is true even if cellulosic fibers are used along with the silicate since the flocculated silicate tends to coat and protect the fiber from flame. If, however, there is a need for the best flammability and flame resistance properties, then the fibers will also be non-flammable or at least flame resistant. Preferred fibers for such papers can be selected from the group consisting of fiberglass and polybenzimidazole.

Fibers made from any type of material can be used for the instant paper. These papers can thus be made with natural or synthetic materials and could include cellulosic, mineral and polymer fibers. Suitably, the fibers could be selected from the group consisting of polybenzimidazole, glass, cellulose, polyamide, aromatic polyamide, polyester, and polyolefin. Other preferred fiber mixtures are selected from the group consisting of polybenzimidazole, glass and cellulose.

The type of fiber, however, can cause variation in the paper's properties. Depending on the intended application, a change in a desired physical characteristic could be very undesirable. It has also been found that processing variations can be used to obtain or enhance particular physical characteristics in the paper. For example, heavy or brisk agitation can be used in the instant preferred process, either before dewatering, during the step 3) non-ionic flocculation, or at both times to improve flexibility in the paper produced. Papers containing cellulose fibers have poorer flexibility, especially when compared to papers having polybenzimidazole fibers. Agitation, however, can be used as described above in order to improve the flexibility of cellulosic paper.

Additives can also be used. Such additives typically would include the additives known and used in the paper industry and any ingredient needed or desired for a particular paper (to obtain a paper suitable for a particular use). These additives would include fillers, brighteners, sizing additives, pigments and other modifiers. Preferably, one or more of titanium dioxide, zinc oxide and carbon black could be used. Particular ingredients like these fulfill a dual role as a filler which also acts as a pigment. Another preferred filler is clay.

Additives can be added at any point or step of the process. It is, however, most preferred that other ingredients and additives are combined and added with the vermiculite. This takes advantage of the fact that the vermiculite and most of the additives are anionic. It is best to combine such additives with the vermiculite when making the suspension.

The following examples are offered to illustrate the present invention and should not be taken to limit it. All parts and percentages are by weight unless otherwise indicated.

EXAMPLES 1-2

Two 12×12 inch samples of paper were made which had a formulation as follows:

| | |
|---|---|
| glass fibers (Evanite 612), ¼" chop length, 4–5 micron diameter | 2.5% |
| polybenzimidizole fiber (PBI) (Hoechst Celanese) 1/16" chop length, 1.5 denure/filiment | 0.60% |
| PBI fiber ⅛" chop length (Hoechst Celanese) 1.5 denure/filiment | 2.4% |
| PBI fiber ¼" chop length (Hoechst Celanese) 1.5 denure/filiment | 12.4% |
| PBI fiber ½" chop length (Hoechst Celanese) 1.5 denure/filiment | 2.1% |
| Vermiculite: Microlite GP903 dispersion (7.5% solids from W. R. Grace) | 80.0% |

The samples were made by mixing the fibers and vermiculite at a 2% solids consistency in a warring blender. The mixture was then diluted with deionized water to 0.14% consistency.

A cationic flocculant poly(diallyldimethylammonium chloride) (Percol 406 - from Allied Colloid) having a weight average gram molecular weight of approximately 300,000 and an ionicity of 6.2 milliequivalents of the amine cation per gram was added in an amount of 0.05 grams of the flocculant per gram of solids.

It was noted that the suspended solids flocculated into small, fine aggregates for a "soft" flocculation. The fibers were thoroughly and evenly distributed within the aggregates.

Although flocculation had occurred at this point, the flocced particles were so fine that the aqueous mixture would drain only very slowly. The second flocculant was used to achieve faster drainage and also to get a paper with superior characteristics.

The polyacrylamide non-ionic flocculant (Clarifloc from Polypure) (molecular weight of about 7,000,000 grams/mole) was added in an amount of 0.07 grams per gram of solids. A second flocculation was seen and agitation was stopped immediately to prevent breakdown of the flocs. It was noted that the floc at this point was in much larger chunks, and the water was much more drainable.

The mixture was then transferred to a wetform mold having a 70 mesh screen, diluted to 0.11% solids with tap water, and was drained. The 12×12 inch mat which was formed was pressed for approximately 30 seconds at 500 pounds per square inch (PSI).

The paper was then dried on a drum dryer. The paper obtained had a basis weight (sheet mass/unit area) of 4.5 oz./yd$^2$.

Physical Testing:

A) Projected applications of the paper such as fire resistant shields and wall paper (frequently used in the aeronautics industry) required good flexibility. Many such applications require paper that have an MIT fold level of 200 or more double folds. For most uses that require flexibility, the paper's flexibility should at least be better than that of paper made with flocculants like guanidine of U.S. Pat. No. 4,707,298.

B) The dry paper samples produced by Example 1 also had greater "internal bond strength" (the internal adhesion and cohesion between the flocculated, wet-laid ingredients) than was found in the papers of U.S. Pat. No. 4,707,298.

C) The flame resistance and noncombustibility of the paper was to be maintained.

The following tests were employed in assessing the new paper product:

1) Folding Endurance—M.I.T. Fold ASTM D 2176-69, TMD

2) Z-Direction Tensile - TAPPI T541

The results of these tests are given in the following tables.

TABLE 1

The MIT fold test data below shows the data for two paper sheet samples 1 and 2 (having 400 g. basis weight). Three from each sheet were tested as a, b, and c.

| DADMAC/Nonionic Sample | Thick (in) | # of Dbl Folds |
|---|---|---|
| 1a) | .0116 | 16,203 |
| 1b) | .0114 | 46,949 |
| 1c) | .0119 | 15,042 |
| 2a) | .0131 | 12,354 |
| 2b) | .0136 | 6,908 |

TABLE 1-continued

The MIT fold test data below shows the data for two paper sheet samples 1 and 2 (having 400 g. basis weight). Three from each sheet were tested as a, b, and c.

| DADMAC/Nonionic Sample | Thick (in) | # of Dbl Folds |
|---|---|---|
| 2c) | .0131 | 12,215 |

COMPARATIVE EXAMPLE

The fact that the paper described herein does provide better flexibility can be appreciated from the MIT Fold Test data taken on paper of the same formulation that was made with guanidine as the flocculant.

TABLE 2

| Guanidine Sample | Thick (in) | # of Dbl Folds |
|---|---|---|
| A | .0095 | 627 |
| B | .0105 | 3,853 |
| C | .0090 | 3,031 |

The Z-direction tensile strength tests were taken on the above paper samples 1 and 2, again by running tests on three squares taken from each sample sheet. The results are given below in Table 3, and a comparison with the guanidine-flocculated paper formulation is shown as Samples D-G under Table 4.

TABLE 3

TEST: Z-DIRECTION TENSILE TAPPI T541

| DADMAC/Nonionic Sample | Tensile Strength (PSI) |
|---|---|
| 1a) | 30.8 |
| 1b) | 33.4 |
| 1c) | 35.3 |
| 2a) | 26.7 |
| 2b) | 33.7 |
| 2c) | 31.0 |

TABLE 4

| Guanidine Flocculated Sample | Tensile Strength (PSI) |
|---|---|
| D | 2.60 |
| E | 3.36 |
| F | 2.94 |
| G | 5.78 |

EXAMPLE 3

Paper was made using the formulation and procedure described above for Examples 1 and 2, and the following tests were run to insure that the paper also had the desired flammability/smoke characteristics.

A) The limiting oxygen index was obtained on this paper using the ASTM D2863-77 test, and the Critical Oxygen Index for this paper was determined to be 100%.

B) The Vertical Burn Test/60 sec. (BSS 7230).

TABLE 5

| Sample | Extinguish Time (sec) | Burn Length & Glow (in) | Dripping Time (sec) | Pass/Fail |
|---|---|---|---|---|
| A) | 0 | 1.1 | 0 | Pass |
| B) | 0 | 1.3 | 0 | Pass |
| C) | 0 | 1.4 | 0 | Pass |
| D) | 0 | 1.4 | 0 | Pass |
| E) | 0 | 1.5 | 0 | Pass |

TABLE 5-continued

| Sample | Extinguish Time (sec) | Burn Length & Glow (in) | Dripping Time (sec) | Pass/Fail |
|---|---|---|---|---|
| F1 | 0 | 1.6 | 0 | Pass |

What is claimed is:

1. A mineral paper comprising a wet-laid sheet of 1) fibers, 2) a floc of a chemically delaminated 2:1 layered silicate selected from the group, consisting of mica and vermiculite, the said floc having a cationic polymeric flocculant with from about 3 to about 8 milliequivalents of cation per gram of the polymeric flocculant, said cationic polymeric flocculant being present at an amount in the range of from about 3.5 to about 6 percent by weight, and further having a molecular weight in the range of from about 10,000 to about 1,000,000 and 3) a nonionic polyacrylamide flocculant at an amount in the range of from about 5.5 to about 8 percent by weight which further has a molecular weight in the range of from about 2,000,000 to 10,000,000.

2. The paper of claim 1 wherein the fiber is selected from the group consisting of polybenzimidazole, glass, cellulose, polyamide, polyolefin, aromatic polyamide, and polyester.

3. The paper of claim 1 wherein the cationic polymeric flocculant is an amine.

4. The paper of claim 1 also having a filler.

5. The paper of claim 1 having from about 5 to about 85% by weight fiber and from about 20 to about 95% by wt. of the silicate.

6. The paper of claim 1 wherein the fiber is selected from the group consisting of polybenzimidazole and glass.

7. A process for the preparation of mineral paper which comprises the steps of 1) preparing an aqueous suspension containing, as solids ingredients, fibers and a chemically delaminated 2:1 layered silicate selected from the group consisting of mica and vermiculite, 2) adding a cationic polymeric flocculant at an amount in the range of from about 0.04 to about 0.06 grams per gram of the solids ingredients to obtain a flocculation, wherein the cationic flocculant has a molecular weight in the range of from about 10,000 to about 1,000,000, 3) flocculating again with a non-ionic polyacrylamide flocculant at an amount in the range of from about 0.06 to about 0.08 grams per gram of the solids ingredients, said non-ionic polyacrylamide flocculant having a molecular weight of from about 2,000,000 to about 10,000,000, and 4) dewatering to form the mineral paper.

8. The process of claim 7 wherein the fiber is selected from the group consisting of polybenzimidazole, glass, cellulose, polyamide, polyolefin, aromatic polyamide, and polyester.

9. The process of claim 7 wherein the cationic polymeric flocculant has from about 3 to about 8 milliequivalents of cation per gram of the flocculant.

10. The process of claim 7 wherein the cationic polymeric flocculant is an amine.

11. The process of claim 7 wherein the fiber is selected from the group consisting of polybenzimidazole and glass.

12. The process of claim 7 having from about 5 to about 85% by wt. fiber and from about 20 to about 95% by wt. of the silicate.

* * * * *